United States Patent [19]

Byrd

[11] Patent Number: 4,957,293

[45] Date of Patent: Sep. 18, 1990

[54] GOLF BALL MARKER AND HOLDER APPARATUS FOR MARKER

[76] Inventor: Danny L. Byrd, 2317 W. Dobbins Rd., Phoenix, Ariz. 85041

[21] Appl. No.: 361,359

[22] Filed: Jun. 5, 1989

Related U.S. Application Data

[63] Continuation-in-part of Ser. No. 205,474, Jun. 13, 1988, abandoned.

[51] Int. Cl.[5] ..... A63B 53/00

[52] U.S. Cl. ..... 273/162 D; 273/32 A

[58] Field of Search ..... 273/162 R, 162 B–162 F, 273/32 A, 32 B, 81 R; 24/606, 607, 625, 423, 297, DIG. 17, 108; 40/317; 224/918; D21/234

[56] References Cited

U.S. PATENT DOCUMENTS

| | | | |
|---|---|---|---|
| 1,942,122 | 1/1934 | Reach | 273/162 D |
| 3,063,114 | 11/1962 | Perrochat | 24/297 |
| 3,093,874 | 6/1963 | Rapata | 24/297 X |
| 3,262,168 | 7/1966 | Overhoff | 24/297 |
| 3,774,913 | 11/1973 | Dien | 273/162 D |
| 3,779,559 | 12/1973 | Taylor | 273/162 D |
| 3,791,652 | 2/1974 | Shuler | 273/162 D |
| 4,380,337 | 4/1983 | Dimatteo | 273/162 D |
| 4,403,377 | 9/1983 | Mizusawa | 24/297 X |
| 4,591,156 | 5/1986 | Attenni | 273/73 J |
| 4,807,335 | 2/1989 | Candea | 24/607 X |
| 4,822,052 | 4/1989 | Dimmick et al. | 273/162 D |
| 4,858,925 | 8/1989 | DeStefano | 273/162 D |

FOREIGN PATENT DOCUMENTS

| | | | |
|---|---|---|---|
| 884123 | 12/1961 | United Kingdom | 24/297 |
| 1030163 | 5/1966 | United Kingdom | 24/297 |
| 1043683 | 9/1966 | United Kingdom | 273/162 D |
| 2128485 | 5/1984 | United Kingdom | 273/162 D |

*Primary Examiner*—Edward M. Coven
*Assistant Examiner*—Sebastiano Passaniti
*Attorney, Agent, or Firm*—H. Gordon Shields

[57] ABSTRACT

A golf putter shaft grip receives an anchor element for holding a golf ball marker, with the holder locked into the end of the grip so that the marker is conveniently disposed for easy removal for use in marking a ball location on a putting green, and for re-insertion and storage in the anchor element.

5 Claims, 1 Drawing Sheet

GOLF BALL MARKER AND HOLDER APPARATUS FOR MARKER

CROSS REFERENCE TO RELATED APPLICATION

This application is a continuation-in-part application of copending application Ser. No. 07/205,474, filed Jun. 13, 1988, and now abandoned.

BACKGROUND OF THE INVENTION

1. Field of the Invention:

This invention relates to golf club markers and, more particularly, to golf club markers and to a holder for the golf club marker, with the holder secured to the grip of a putter.

2. Description of the Prior Art:

U.S. Pat. No. 2,178,872 (Engstrom) discloses an attachment for a golf club shaft, with a marker being received in the attachment. The attachment is appropriately secured to the end of the shaft, and a marker is in turn secured in the attachment or housing.

U.S. Pat. No. 2,261,959 (Buttikofer) discloses another attachment to the end of a golf club shaft for holding a marker. Different embodiments of markers and holders are shown.

U.S. Pat. No. 2,700,547 (Kraeling, Jr.) discloses another type of attachment for a golf club shaft for holding a marker. In the '872 and '959 patents discussed above, the markers are held generally perpendicularly to the longitudinal axis of the shaft. In the '547 patent, the marker is held in a holder substantially parallel to the longitudinal axis of the shaft.

U.S. Pat. No. 3,622,157 (Hatch) discloses a marker secured to a golf green repair tool. The marker includes a flat disc and a stem secured to the disc head. The marker is held in place by the stem.

U.S. Pat. No. 3,774,913 (Dien) discloses a combination of a green fixing tool and a marker holder secured to the end of a golf club shaft. The marker in the '913 patent includes a circular head and a stem. The stem is secured to the holder to maintain the marker.

U.S. Pat. No. 3,779,559 (Taylor) discloses a golf club grip and a marker which secures to the grip. The grip includes a circular socket which receives the head of the ball marker. The grip also includes a pole which extends downwardly through the end of the grip from the socket and which receives the shank of the marker.

U.S. Pat. No. 3,905,525 (Kawamata) discloses a ball marker designed to be secured to a shoe or belt of a user, not to the grip of a putter. The marker includes a shank which cooperates with different elements in the holder for securing the marker to the holder. For example, a straight shank is disclosed on the marker, and a resilient O-ring is disposed in the holder for applying an inwardly directed resilient force against the shank of the marker. In other embodiments, the shank includes grooves which mate with different types of elements, such as ridges or even an O-ring, to secure the marker to the holder.

U.S. Pat. No. 4,239,216 (Bauer) discloses a combination green repair tool and marker holder secured to the end of a putter shaft. A marker is held in the slot. The slot is generally perpendicular to the longitudinal axis of the shaft.

U.S. Pat. No. 4,380,337 (DiMatteo) discloses a holder and marker combination in which the holder extends through a small aperture in the end of a golf club grip.

The holder includes a relatively flat top portion with a cup extending upwardly from the center of the top flat surface to cooperate with a button which extends downwardly from the bottom surface of the marker into the cup. A frictional snap engagement is thus provided.

U.S. Pat. No. 4,403,377 (Mizusawa) discloses a fastening system which discloses a panel, a cover for the panel, and a wedge member to secure the cover to the panel. The base includes a portion which extends through a hole in the panel, and the wedge includes a shank portion which extends through the base and into the panel.

U.S. Pat. No. 4,591,156 (Attenni) discloses a device for securing a racket to the wrist of a player. The apparatus includes a ring element which has a shank and an outwardly tapering end on the shank. The element extends into a resilient holder. The holder includes resilient legs which spread apart to receive the shank, which extends down below the bottom of the resilient legs.

It will be noted that all of the apparatus discussed above, with the exception of the apparatus of the '157 patent, are all relatively complicated. The complexity translates into manufacturing costs. In turn, the cost to the consumer or user is probably relatively high, considering the practical utility for which the apparatus is designed. Accordingly, a golfer may prefer to simply utilize a coin to mark the location of a ball on a putting green rather than bother with relatively complicated and relatively expensive marker apparatus.

The apparatus of the present invention is relatively simple, and utilizes handle grips in contemporary use on most putters.

SUMMARY OF THE INVENTION

The invention described and claimed herein comprises a holder for a marker, and the marker is securable to a grip on the end of a putter shaft. The marker includes a head and a shank or stem secured to the head. The stem or shank extends into a snap anchor and is frictionally held in the snap anchor. The snap anchor in turn is frictionally held in the grip at the end of a putter shaft.

Among the objects of the present invention are the following;

To provide new and useful golf putter apparatus;

To provide new and useful marker apparatus securable to an anchor and to a putter grip;

To provide new and useful snap anchor apparatus having a pair of bores which receive a tapered shank of a golf ball marker; and To provide a new and useful golf ball marker apparatus including a head and a shank secured to the head and a mating anchor which receives the shank to secure the marker to the grip of a putter shaft.

DESCRIPTION OF THE PREFERRED EMBODIMENT

Figure 1:
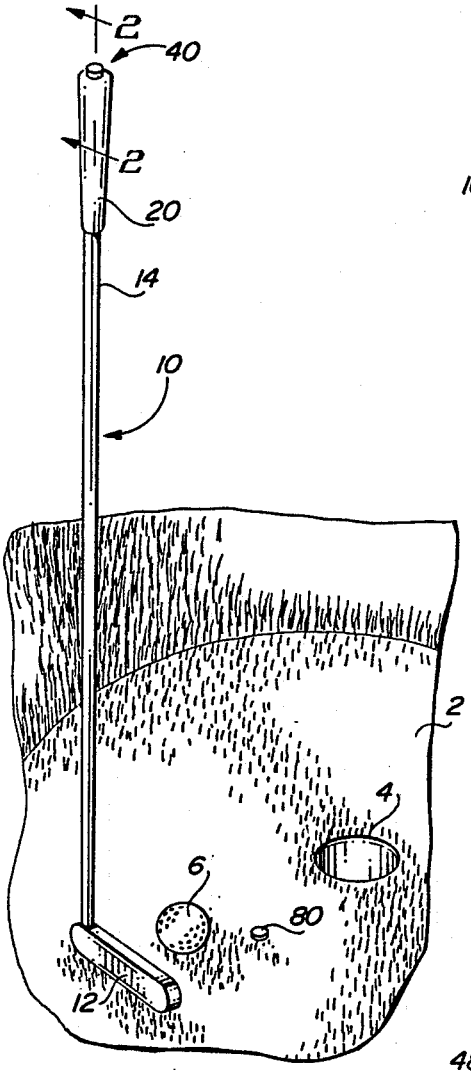
FIG. 1 is a perspective view of a portion of a putting green and a putter including the apparatus of the present invention secured to the putter.

FIG. 1 is a perspective view of a portion of a golf putting green 2, with a cup or hole 4 extending into the green 2. A golf ball 6 is illustrated spaced apart from the cup 4. A golf putter 10 is in turn disposed adjacent to the ball 6. The putter 10 includes a head 12 and a cylindrical shaft 14 secured to the head 12. A grip 20 is disposed on the shaft 14 at the outer end of the shaft 14, remote from the head 12.

Figure 2:
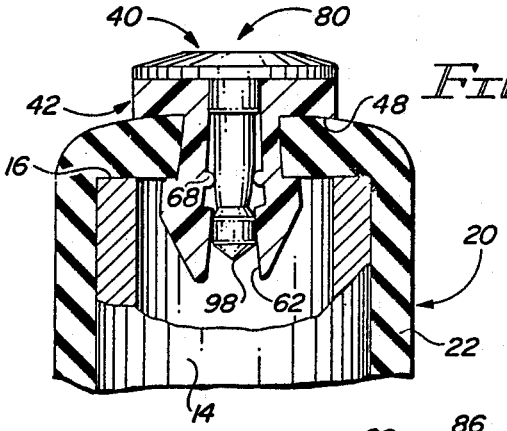
FIG. 2 is an enlarged view in partial section taken generally along line 2—2 of FIG. 1.
Figure 3:
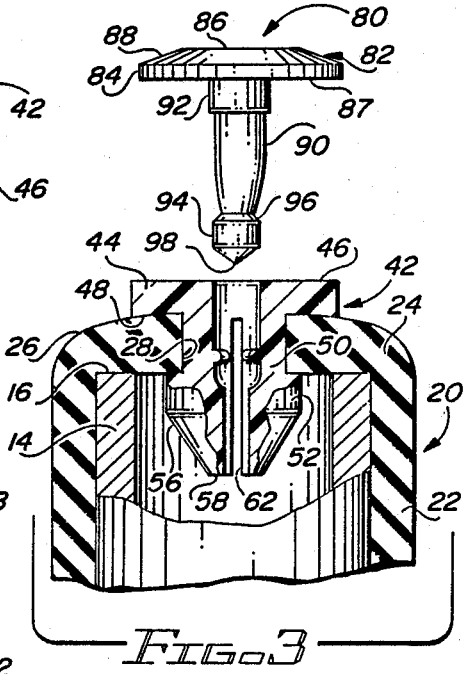
FIG. 3 is an enlarged, exploded view in partial section of the apparatus of FIG. 2.

FIG. 2 is an enlarged view in partial section of a portion of the grip 20 of FIG. 1, taken generally along line 2—2 of FIG. 1. In FIG. 2, marker apparatus 40 of the present invention is shown secured to the grip 20 on the end of the cylindrical shaft 14. The marker apparatus 40 includes two portions, a snap anchor 42 and a marker 80. The marker 80 is shown in FIG. 2 secured to the snap anchor 42. FIG. 3 is an enlarged view of the snap anchor 42 with the marker 80 spaced apart from the anchor 42.

Figure 5:
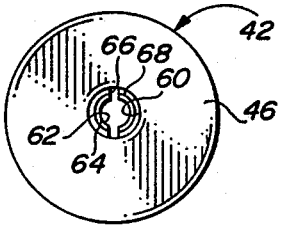
FIG. 5 is a top view of the apparatus of FIG. 4.
Figure 6:
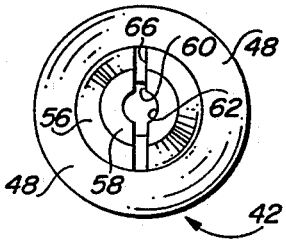
FIG. 6 is a bottom view of the apparatus of FIG. 4.
Figure 4:
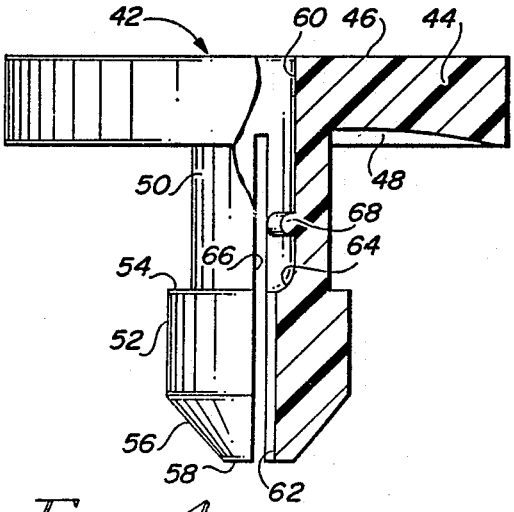
FIG. 4 is an enlarged view in partial section of a portion of the apparatus of the present invention.

FIG. 4 is an enlarged side view of the snap anchor 42, with half of the snap anchor sectioned and cut away to show details of the construction of the anchor 42. FIG. 5 is a top view of the anchor 42, and FIG. 6 is a bottom view of the anchor 42.

Figure 7:
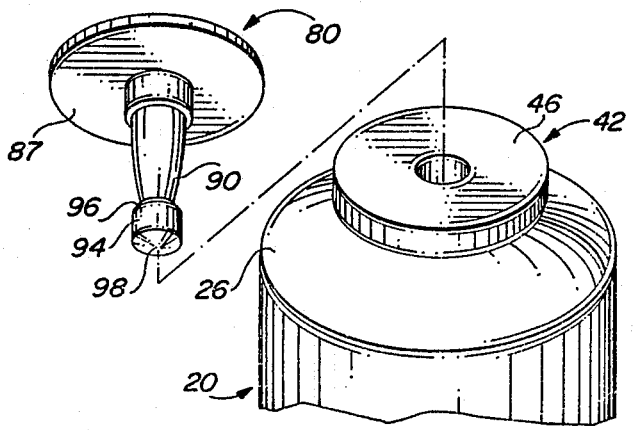
FIG. 7 is an exploded perspective view of the apparatus of the present invention in its use environment.

FIG. 7 is a perspective view of the upper portion of the grip 20, showing the anchor 42 disposed on the grip 20, with the marker 80 spaced apart from the anchor 42.

For the following discussion, reference will be made generally to FIGS. 1–7. As required, or as helpful, a specific Figure will be referred to.

The shaft 14, at the grip 20, is generally of a cylindrical configuration. The shaft 14 terminates in a top 16. The top 16 is simply a generally flat end of the shaft 14. The top 16 is generally perpendicular to the longitudinal axis of the shaft 14.

The grip 20 is disposed about the shaft 14 for convenience of the user of the putter 10. The grip 20 is also of a generally cylindrical configuration, with a cylinder portion 22 disposed about the shaft 14. The outer end of the grip 20, and the outer end of the shaft 14, is closed by a top portion 24. The top portion 24 of the grip 20 generally includes a top or outer convex surface 26 with a hole 28 extending axially through the top portion 24.

The hole or bore 28 is generally aligned with the longitudinal axis of the shaft 14 and with the cylindrical portion 22 of the grip 20. The apparatus of the present invention utilizes the hole 28 in the top portion 24 to secure the anchor 42 to the grip 20 and accordingly to the putter 10. Typically, the grip 20 is made of a rubber or rubber-like material. The properties of the material are used, at the hole 28, to hold the anchor 42 in place.

The snap anchor 42 includes a generally cylindrical head 44 having a flat top 46 and a generally concave bottom 48. The concave bottom 48 fits the generally convex outer surface 26 of the grip 20.

Extending downwardly from the head 44 is a stem 50. The stem 50 is of a generally cylindrical configuration and is disposed coaxially with respect to the cylindrical head 44 in the hole 28. The diameter of the stem 50 is slightly greater than the diameter of the hole 28. The elasticity of the material out of which the grip 20 is made causes an inward bias on the stem 50 to hold the anchor 42 in place.

At the bottom of the stem 50, there is a locking cylindrical portion 52 which has a diameter slightly greater than that of the stem 50. A radially outwardly extending shoulder 54 extends outwardly from the bottom of the stem 50 at the cylindrical locking portion 52. The distance from the head 44 to the locking portion 52 is about the same as the thickness of the top portion 24 of the grip 20. Accordingly, the bottom of the top portion 24 about the hole 28 is disposed on the shoulder 54. The anchor is thus secured to the grip 20. Obviously, the locking cylindrical portion 52 has a diameter substantially greater than that of the hole 28 in order to help lock the anchor 42 to the grip 20.

At the bottom of the cylindrical portion 52 is an inwardly tapering portion 56. The tapered portion 56 terminates in a flat end 58. The tapered portion 56 helps to expand the hole 28 to let the anchor fit into the grip 20.

A pair of bores extend through the head 44, the stem 50, and the cylindrical lock portion 52. There is a top or upper portion 60 which extends generally through the head 44 and the stem 50. A lower bore 62 extends through the cylindrical portion 62. An inwardly extending or tapering shoulder portion 64 extends between the bottom of the upper bore 60 and the top of the lower bore 62. The shoulder portion 64 comprises a transition area between the relatively large diameter upper bore 60 and the relatively small diameter lower bore 62.

An axially extending slot 66 extends vertically through the stem 50 and the cylinder 52.

Extending radially inwardly in the bore 60 is a convex locking ridge 68. The ridge 68 is divided into two portions by the slot 66. The ridge 68 extends circumferentially in the bore 60 of the stem 50, and is divided into two convex arcuately extending portions or segments by the slot 66.

As best shown in FIG. 2, the axial length of the stem 50 is about the same as the thickness of the head 24 at the hole or bore 28. Accordingly, when the anchor 42 is disposed in the hole 28 of the grip 20, the shoulder 54 extends radially outwardly from the hole 28 to secure or lock the anchor 42 in the hole 28 of the head 24 of the grip 20. As has been mentioned, the overall diameter of the stem 50 is slightly greater than the diameter of the hole 28, thus enhancing the gripping capability of the top or head portion 24 of the grip 20 with respect to the anchor 42. Essentially, the top portion 24 exerts a radially inwardly extending bias on the stem portion 50 of the anchor 40. The radially directed force of the grip 20 urges the two portions of the stem 50 towards each other. The "two portions" comprise the portions of the stem, on opposite sides of the slot 66. Thus, the grip 20 not only helps to hold the anchor 42 in place, but it also helps to hold the marker 80 in the anchor 42.

The marker 80 includes a generally cylindrical head 82 and a tapered shank or stem 90. The head 82 includes a relatively short cylindrical portion 84 and an upper generally conical portion 88. The marker includes a flat top 86. The conical portion 88 comprises an inwardly tapered portion between the relatively short cylindrical portion 84 and the flat top 86.

The marker 80 has a flat bottom 87 disposed on the flat top 46 of the anchor 42 when the marker is secured to the anchor. Flat bottom 87 contacts the surface of the green 2, as shown in FIG. 1.

Extending downwardly from the head 82, and coaxially aligned therewith, is the tapered shank or stem 90. The shank or stem 90 tapers inwardly as it extends downwardly from the head 82 to a cylindrical bottom 94. The diameter of the cylindrical bottom portion 94 is about the same as the diameter of the upper portion of the stem 90 adjacent to the head 82. Between the cylindrical bottom portion 94 and the bottom of the stem 90 is a conically tapered surface 96. The conical tapered surface 96 is simply a transition from the reduced diameter at the bottom of the shank or stem 90 to the cylindrical portion 94.

A cylindrical portion 92 is disposed on the stem 90 immediately below the bottom 87 of the head 82. The diameter of the cylindrical portion 92 is about the same as the diameter of the bore 60, and accordingly the marker 80 is held relatively securely to prevent jiggling or lateral movement in the anchor 42.

The bottom of the cylinder 94 includes a pointed end 98 which tapers to a point from the cylindrical portion 94.

The pointed end 98 is conically tapered from the cylindrical portion 94 to a point. The purpose of the pointed end 98, is two fold, first to guide the stem 90 into the bores 60 and 62 of the anchor 42 and to simplify or ease the movement of the shank 90 into the ground of the green 2 to mark the location of a ball.

The diametral distance between the two segments of the ridge 68 is slightly less than the diameter of the cylindrical lower portion 94 when the stem 50 is in its relaxed or normal configuration, without its two portions being spread apart by the stem 90 and its lower cylindrical portion 94 when the marker is secured to the anchor 42.

The overall length of the stem 90 is slightly less than the overall axial length of the snap anchor 42. That is, the length of the stem 90 is less than the length of the bores 60 and 62. The diameter of the cylindrical portion 94 is greater than that of the bores 60 and 62 and the marker 80 is accordingly locked into the anchor 42. The slot 66 allows the two halves of the stem 50 to spread apart to receive the stem 90 of the marker 80. The pointed end 98 of the stem 90 aids in camming the two halves of the stem 50 apart. The inherent radially inwardly bias of the two halves of the lower portion of the stem to, exerted on the cylindrical portion 94 in the bore 82, holds the marker 80 in place in the anchor 42. The bore 62, having a reduced diameter, acts as a primary lock for the stem 90 and accordingly for the marker 80.

The overall length of the cylindrical portion 94, which comprises the lower portion of the marker 80, is about the same as the distance between the ridge 68 and the shoulder 64 of the stem 50. Accordingly, if the marker 80 is accidentally jarred loose from the anchor 42 to the extent that the cylindrical portion 94 moves out of the bore 62, the ridge 68 comprises a secondary lock or holding element to hold the stem 50 in the bore 60 to prevent the marker 80 from accidentally coming out of the anchor 42. Thus, a positive axially outward pull or force on the marker 80 is required to remove the marker 80 from the anchor 42. Moreover, with the ridge 68 disposed above the shoulder 64 by at least the axial length of the cylindrical portion 94, the portions of the stem 50 move inwardly as the cylindrical portion 94 moves out of the bore 62 and into the shoulder 64 and into the larger diameter bore 60 substantially completely in order to utilize the secondary locking ridge 68 to hold the marker 80 in the anchor 42.

As indicated above, the top portion 24 of the grip 20 provides a radially inwardly extending bias on the stem 50, and the inward bias helps to hold the marker stem 90 in place in the bores 60 and 62. At the same time, the tapering conical portions 98 and 96 provide cam surfaces for urging the two portions of the stem 50 and the cylindrical portion 52 apart or away from each other to let the marker 80 be inserted and withdrawn from the anchor 42.

In addition to the bias of the grip 80 on the stem 50 of the anchor 42, the material out of which the anchor 42 is made also provides an inherent bias to help hold the marker 80 in place.

Both the anchor 42 and the marker 80 may be preferably made of plastic material, such as nylon or the like. Such plastics are long-lasting, resilient, and afford lubrication, if such is required, between the grip and the marker as the marker is inserted into and withdrawn from the anchor.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Golf ball marker apparatus usable in combination with a putter having a shaft and a grip on the end of the shaft and a hole having a diameter in the grip, comprising, in combination:

marker means for marking the location of a golf ball on a putting green, including a marker head, stem means secured to the marker head and adapted to extend into the green, including a first portion adjacent to the marker head, having a first diameter, a second portion secured to the first portion and having a second diameter which is less than the first diameter and which tapers inwardly to a third diameter remote from the first portion, and a bottom portion on the stem means remote from the marker head having an outwardly sloping portion adjacent to the third diameter extending to a generally cylindrical portion and a conical tip remote from the outwardly sloping portion; and anchor means for holding the marker means to the grip of the putter shaft, including a head an anchor stem secured to the head and extending through the hole in the grip for securing the anchor means to the grip and having a diameter slightly greater than the diameter of the hole in the grip, a tip portion secured to the anchor stem remote from the head and having a diameter greater than the diameter of the anchor stem, a shoulder between the anchor stem and the tip portion and adapted to be disposed against the grip about the hole when the anchor means is secured to the grip, a first bore in the head and anchor stem for receiving the stem means of the marker means and having an inner diameter about equal to the first diameter of the first portion of the stem means, ridge means extending circumferentially in the first bore in the anchor stem and having an inner diameter less than the third diameter of the second portion of the stem means and defining a secondary holding element for the marker means, and slot means extending through the anchor stem and the tip portion to allow the anchor stem and the tip portion to expand as the stem means of the marker means extends into the first bore.

2. The apparatus of claim 1 in which the anchor means further includes a second bore extending through the tip portion and defining a primary lock for the marker means and a curved shoulder extending from the first bore to the second bore.

3. The apparatus of claim 2 in which the diameter of the first bore is greater than the diameter of the second bore.

4. The apparatus of claim 1 in which the head of the anchor means includes a concave portion for receiving a mating convex portion of the grip.

5. The apparatus of claim 1 in which the ridge means extends convexly into the first bore and includes two arcuate portions divided by the slot means.

* * * * *